US010105981B2

(12) United States Patent
Broberg et al.

(10) Patent No.: US 10,105,981 B2
(45) Date of Patent: Oct. 23, 2018

(54) TRANSFER LAMINATION

(71) Applicant: Assa Abloy AB, Stockholm (SE)

(72) Inventors: Matthew Broberg, Mendota Heights, MN (US); Gary Countryman, Jr., Columbia Heights, MN (US)

(73) Assignee: Assa Abloy AB, Stockholm (SE)

( * ) Notice: Subject to any disclaimer, the term of this patent is extended or adjusted under 35 U.S.C. 154(b) by 0 days.

(21) Appl. No.: 15/577,960

(22) PCT Filed: Jul. 13, 2016

(86) PCT No.: PCT/IB2016/054186

§ 371 (c)(1),
(2) Date: Nov. 29, 2017

(87) PCT Pub. No.: WO2017/025827

PCT Pub. Date: Feb. 16, 2017

(65) Prior Publication Data

US 2018/0147876 A1 May 31, 2018

Related U.S. Application Data

(60) Provisional application No. 62/204,497, filed on Aug. 13, 2015.

(51) Int. Cl.

| | |
|---|---|
| ***B41J 2/325*** | (2006.01) |
| ***B41M 5/382*** | (2006.01) |
| ***B41M 7/00*** | (2006.01) |

(52) U.S. Cl.

CPC ..... *B41M 5/382* (2013.01); *B41M 7/0027* (2013.01); *B41M 2205/10* (2013.01)

(58) Field of Classification Search

CPC ..... B41J 2202/30; B41J 2202/32; B41J 2202/33; B41J 2202/34; B41J 2202/35;

(Continued)

(56) References Cited

U.S. PATENT DOCUMENTS 5,011,570 A * 4/1991 Ohbayashi ..... B41M 5/465 156/182
5,011,707 A 4/1991 Schell et al.

(Continued)

FOREIGN PATENT DOCUMENTS

EP 2521652 B1 3/2014
WO 03039885 A1 5/2003

(Continued)

OTHER PUBLICATIONS

International Search Report and Written Opinion from PCT/US2013/050607, dated Nov. 4, 2013.

(Continued)

*Primary Examiner* — Geoffrey Mruk
*Assistant Examiner* — Scott A Richmond
(74) *Attorney, Agent, or Firm* — Brian D. Kaul; Westman, Champlin & Koehler, P.A.

(57) ABSTRACT

In a transfer printing method using a transfer layer on a carrier layer, an image is printed over a transfer section of the transfer layer using a thermal print head and a print ribbon. At least one non-transfer portion of the transfer section is heated using the thermal print head without bonding the at least one non-transfer portion of the transfer section to the print ribbon. The at least one non-transfer portions of the transfer section are transferred from the carrier layer to an adhesive panel of the print ribbon using the thermal print head. Imaged transfer portions of the transfer section remain adhered to the carrier layer. The imaged transfer portions of the transfer section are then transferred from the carrier layer to a substrate using a transfer device.

13 Claims, 4 Drawing Sheets

(58) Field of Classification Search
CPC ..... B41J 2/32; B41J 2/325; B41J 3/385; B41J 3/4075; B41J 3/546; B41J 11/0015; B41M 5/382; B41M 7/0027; B41M 2205/10
See application file for complete search history.

(56) References Cited

U.S. PATENT DOCUMENTS

| | | | | |
|---|---|---|---|---|
| 5,220,343 | A | 6/1993 | Takanashi et al. | |
| 5,990,918 | A | 11/1999 | Baxendale | |
| 6,264,296 | B1 | 7/2001 | Klinefelter et al. | |
| 6,554,044 | B2 | 4/2003 | Paulson et al. | |
| 6,803,936 | B2 | 10/2004 | Odaka et al. | |
| 7,162,035 | B1 | 1/2007 | Durst et al. | |
| 7,206,096 | B1 | 4/2007 | Sasaki et al. | |
| 8,956,490 | B1 | 2/2015 | Karst | |
| 9,427,944 | B2 | 8/2016 | Woizeschke | |
| 9,802,398 | B2 | 10/2017 | Rieck et al. | |
| 2002/0101497 | A1 | 8/2002 | Kwasny et al. | |
| 2004/0207714 | A1* | 10/2004 | Takahashi | B41J 2/0057 347/216 |
| 2005/0078998 | A1 | 4/2005 | Lien et al. | |
| 2005/0140768 | A1 | 6/2005 | Aspenns et al. | |
| 2005/0269033 | A1 | 12/2005 | Kohira et al. | |
| 2013/0032288 | A1 | 2/2013 | Lien et al. | |
| 2015/0217549 | A1* | 8/2015 | Rieck | B32B 37/025 156/230 |
| 2016/0101608 | A1* | 4/2016 | Woizeschke | B41M 3/12 156/234 |

FOREIGN PATENT DOCUMENTS

| | | | |
|---|---|---|---|
| WO | 2008108904 | A1 | 9/2008 |
| WO | 2008118424 | A1 | 10/2008 |
| WO | 2011085174 | A2 | 7/2011 |
| WO | 2011085174 | A3 | 7/2011 |
| WO | 2014022088 | A1 | 2/2014 |
| WO | 2014158146 | A1 | 10/2014 |
| WO | 2017025827 | A1 | 2/2017 |

OTHER PUBLICATIONS

International Preliminary Report on Patentability Report and Written Opinion from PCT/US2011/020483, dated Jul. 19, 2012.
International Search Report and Written Opinion from PCT/US2011/020483, dated Jul. 22, 2011.
International Search Report and Written Opinion from PCT/US2013/023010, dated Nov. 14, 2013.
International Search Report and Written Opinion from PCT/IB2016/054186, dated Sep. 30, 2016.
Communication pursuant to Rules 161(1) and 162 EPC for European Application No. 13740482.8, dated Apr. 24, 2015.

* cited by examiner

TRANSFER LAMINATION

CROSS-REFERENCE TO RELATED APPLICATION

This Application is a Section 371 National Stage Application of International Application No. PCT/IB2016/054186, filed Jul. 13, 2016 and published as WO/2017/025827 A1 on Feb. 16, 2017, in English, which claims the benefit of U.S. Provisional Application Ser. No. 62/204,497 filed Aug. 13, 2015 under 35 U.S.C. § 119(e), the contents of which are hereby incorporated by reference in their entirety.

BACKGROUND

Credentials include identification cards, driver's licenses, passports, and other documents. Such credentials are formed from credential or card substrates including paper substrates, plastic substrates, cards and other materials. Such credentials generally include printed information, such as a photo, account numbers, identification numbers, and other personal information. Credentials can also include data that is encoded in a smartcard chip, a magnetic stripe, or a barcode, for example.

Credential production devices process credential substrates by performing at least one processing step in forming a final credential product. One such process is a transfer or laminating process that transfers a material to a surface of the card substrate using a transfer device, such as a heated laminating roller. This process can be used to transfer an image to the surface of the card substrate and/or provide protection to the surface of the card substrate from abrasion and environmental conditions, for example.

The material transferred to the surface of the card substrate using the transfer device is generally one of two types: a patch laminate, or a fracturable laminate or transfer layer often referred to as a "thin film laminate." The patch laminate is generally a pre-cut polyester film that has been coated with a thermal adhesive on one side. The pre-cut patch is removably attached to a continuous carrier layer which is generally a coated polyester material. The pre-cut patch is attached to the liner with the thermal adhesive side exposed and available for lamination to the substrate. The transfer device is used to heat the patch to activate the adhesive and press the patch to the surface of the substrate to bond the patch onto the surface.

One disadvantage to the use of a patch laminate is that it does not provide edge-to-edge protection to the surface of the card substrate because it must be formed slightly smaller than the surface of the card to ensure that the patch laminate does not extend beyond the card's edges. Another disadvantage to the use of the patch laminate appears when the surface of the card substrate requiring protection includes a feature over which the patch laminate should not be applied. Such features may include, for example, a magnetic stripe, a signature panel, a surface hologram feature, or electrical contacts of a smartcard module. In order to provide protection of graphics when these features are present, portions of the patch laminate must be removed prior to lamination to expose the feature. Further, it may be desirable to avoid heating some portions of the surface of the card substrate, something which is generally not possible using the heated roller.

Transfer layers are generally continuous resinous materials that have been coated onto a continuous carrier layer or backing to form a transfer ribbon. The side of the resin material that is not attached to the continuous carrier layer is generally coated with a thermal adhesive which is used to create a bond between the resin and the surface of the substrate. The transfer device is used to activate the adhesive and press the resinous material against the surface of the substrate to bond the material to the surface. The carrier layer or backing is removed to complete the lamination process.

The transfer layer may also be in the form of a print intermediate, on which an image may be printed in a reverse-image printing process. In the reverse-image printing process, an image is printed to the exposed side of the transfer layer. Next, the image on the transfer layer is registered with the card substrate. The transfer device is used to activate the adhesive on the imaged transfer layer causing the imaged transfer layer to bond to the surface of the card substrate. A backing of the overlaminate material is removed from the bonded imaged transfer layer to complete the transfer of the image to the card substrate.

The transfer layer provides a degree of protection to the surface of the substrate as well as the image printed on the transfer layer. Some transfer films include a protective layer that is configured to provide an additional level of protection to the surface and image. In general, the protective layer increases abrasion resistance, but can also provide protection from other environmental conditions, such as moisture, ultraviolet light, etc.

Sometimes full edge-to-edge coverage of the surface of the substrate with the transfer layer is not desired. For instance, it may be necessary to avoid covering certain features that may be present on the surface of the substrate, such as, for example, a magnetic stripe, a signature panel, and other features mentioned above. One technique that is used to prevent the transference of the transfer layer to select portions of the card surface involves the use of an inhibitor or adhesive panel of a print ribbon, as described in U.S. Publication No. 2015/0217549. The inhibitor panel is positioned over the imaged transfer layer of the transfer ribbon, and the print head selectively activates portions of the inhibitor panel corresponding to non-transfer portions of the imaged transfer layer that should not be transferred to the surface of the substrate. The activation of the selective locations of the inhibitor panel cause those activated portions of the inhibitor panel to adhere to the corresponding non-transfer portions of the imaged transfer layer through the activation of the adhesive in the transfer layer. As the print ribbon is pulled away from the imaged transfer ribbon, the activated portions of the inhibitor layer remove the corresponding imaged non-transfer portions of the transfer layer from the transfer ribbon. The transfer ribbon then includes the remaining imaged transfer layer which was not removed through bonding with the inhibitor layer of the print ribbon.

The gaps in the imaged transfer layer on the transfer ribbon that correspond to the removed non-transfer portions may correspond to the locations of the features of the substrate where the transference of the transfer layer is undesired. Accordingly, the sections of the substrate where the transference of the imaged transfer layer is undesired remain free of the transfer layer following the transference of the remaining imaged transfer layer from the transfer ribbon to the surface of the substrate using the transfer device.

The thickness and durability of the transfer layer affects the success of the above-described non-transfer portions removal process by the inhibitor panel. For instance, thick transfer layers are subject to tearing and fracturing during the removal process resulting in the undesired removal of non-activated portions of the transfer layer and/or the failure to remove parts of the non-transfer portions, or create undesired debris. This prevents the substrate from receiving entirely and only the desired portions of transfer section of the imaged transfer layer (i.e., without the non-transfer portions), resulting in defects.

SUMMARY

Embodiments of the invention are directed to a transfer printing method using a transfer layer on a carrier layer. In some embodiments of the method, an image is printed over a transfer section of the transfer layer using a thermal print head and a print ribbon. At least one non-transfer portion of the transfer section is heated using the thermal print head. The at least one non-transfer portions of the transfer section are transferred from the carrier layer to an adhesive panel of the print ribbon using the thermal print head. Imaged transfer portions of the transfer section remain adhered to the carrier layer. The imaged transfer portions of the transfer section are then transferred to a substrate using a transfer device.

In some embodiments, a resin is transferred to the at least one non-transfer section during the heating step. In some embodiments, the resin is transferred over an entire surface of the at least one non-transfer portion. In some embodiments, the resin is transferred from a resin panel of the print ribbon. In some embodiments, the resin panel is a black resin panel or a heat seal panel.

In some embodiments, the heating of the at least one non-transfer portion includes heating the at least one non-transfer portion through the print ribbon. In some embodiments, the heating of the at least one non-transfer portion occurs without transferring material from the print ribbon to the at least one non-transfer portion. In some embodiments, the at least one non-transfer portion is heated through a blank or used panel of the print ribbon.

In some embodiments, the heating of the at least one non-transfer panel reduces adhesion of the at least one transfer portion to the carrier layer.

In some embodiments, the at least one non-transfer portion is heated during the printing of the image over the transfer section.

In some embodiments, the at least one non-transfer portion is heated before or after the printing of the image over the transfer section.

In some embodiments, the non-transfer portions are transferred to the adhesive panel by positioning the adhesive panel between the print head and the non-transfer portions, and bonding the non-transfer portions to the adhesive panel including heating portions of the adhesive panel that correspond to the non-transfer portions using the print head.

In some embodiments, the transfer layer includes a protective layer having a thickness of in the range of 12-40 μm, such as greater than 12 μm, greater than 15 μm, greater than 20 μm, greater than 25 μm, or greater than 30 μm.

Some embodiments are directed to a lamination process, in which the above-described printing step is not performed. In some embodiments of the lamination process, at least one non-transfer portion of a transfer section of the transfer layer is heated through a print ribbon using the thermal print head, and a resin is transferred from the print ribbon to the at least one non-transfer portion. The non-transfer portions of the transfer section are then transferred from the carrier layer to an adhesive panel of the print ribbon using the thermal print head. A remaining portion of the transfer section on the carrier layer is then transferred to a substrate using a transfer device.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
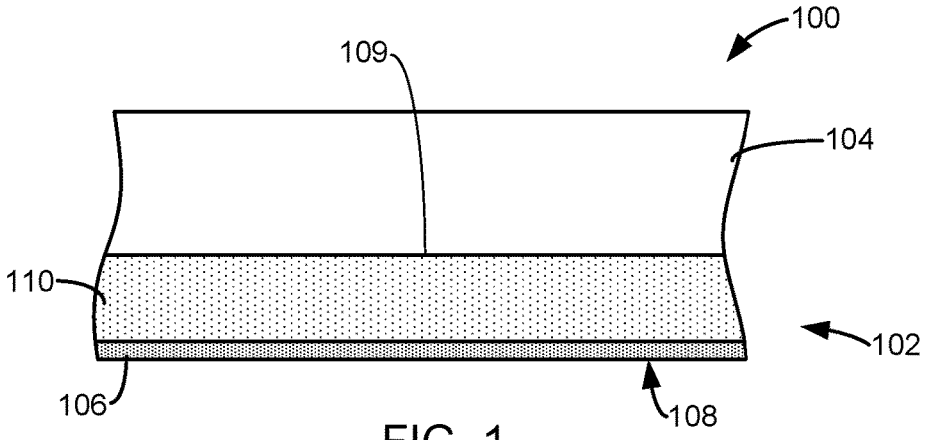
FIG. 1 is a simplified side cross-sectional view of an exemplary transfer ribbon in accordance with embodiments of the invention.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will further be appreciated by one of skill in the art, the present invention may be embodied as methods, systems, and/or computer program products. Accordingly, the present invention may take the form of an entirely hardware embodiment, an entirely software embodiment or an embodiment combining software and hardware aspects. Furthermore, the present invention may take the form of a computer program product on a computer-usable storage medium having computer-usable program code embodied in the medium. Any suitable computer readable medium may be utilized including hard disks, CD-ROMs, optical storage devices, or magnetic storage devices.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

The invention is also described using flowchart illustrations and block diagrams. It will be understood that each block (of the flowcharts and block diagrams), and combinations of blocks, can be implemented by computer program instructions. These program instructions may be provided to a processor circuit, such as a microprocessor, microcontroller or other processor, such that the instructions which execute on the processor(s) create means for implementing the functions specified in the block or blocks. The computer program instructions may be executed by the processor(s) to cause a series of operational steps to be performed by the processor(s) to produce a computer implemented process such that the instructions which execute on the processor(s) provide steps for implementing the functions specified in the block or blocks.

Accordingly, the blocks support combinations of means for performing the specified functions, combinations of steps for performing the specified functions and program instruction means for performing the specified functions. It will also be understood that each block, and combinations of blocks, can be implemented by special purpose hardware-based systems which perform the specified functions or steps, or combinations of special purpose hardware and computer instructions.

FIG. 1 is a simplified side cross-sectional view of an exemplary transfer ribbon 100 in accordance with embodiments of the invention. In some embodiments, the transfer ribbon 100 includes a transfer layer 102 that is attached to a backing or carrier layer 104. The transfer layer 102 is configured to be transferred to a surface of a substrate through a transfer lamination process in accordance with embodiments of the invention.

In some embodiments, the transfer layer 102 is in the form of a fracturable laminate or thin film laminate. In some embodiments, the transfer layer 102 includes an image receptive layer 106 that is configured to receive an image on the surface 108. The image may be printed to the surface 108 in accordance with conventional techniques, such as through dye sublimation or inkjet printing processes.

The transfer ribbon 100 may include other conventional layers or materials that are not shown in order to simplify the illustration. These include a thermal adhesive in the image receptive layer 106, or a thermal adhesive layer on the image receptive layer 106. The thermal adhesive is activated during a transfer lamination process to bond the transfer layer 102 to a substrate. The transfer ribbon 100 may also include a release layer 109 between the transfer layer 102 and the carrier layer 104 that simplifies the release of the transfer layer 102 from the carrier layer 104 during the transfer lamination process. Other conventional materials or layers may also be included in the transfer ribbon 100.

In some embodiments, the transfer layer 102 includes a protective layer 110 located between the image receptive layer 106 and the carrier layer 104. Alternatively, the protective layer 110 may be combined with the image receptive layer 106. The protective layer 110 operates to provide protection to the surface on which the transfer layer 102 is laminated. The protective layer 110 will also protect an image printed on or in the image receptive layer 106 when the transfer layer 102 is laminated to the surface of a substrate.

In some embodiments, the protective layer 110 is a highly durable protective layer that is capable of withstanding 1500 taber cycles. In some embodiments, the protective layer 110 is capable of withstanding 2000-3000+ taber cycles. In some embodiments, the protective layer 110 includes one or more resins. In some embodiments, the protective layer 110 has a thickness in the range of 12-40 μm, such as greater than 12 μm, greater than 15 μm, greater than 20 μm, greater than 25 μm, and greater than 30 μm. However, embodiments of the transfer lamination process described herein may be used with transfer layers 102 having protective layers 110 comprising other resins and having a thickness that lies outside the exemplary ranges provided above.

Figure 2:
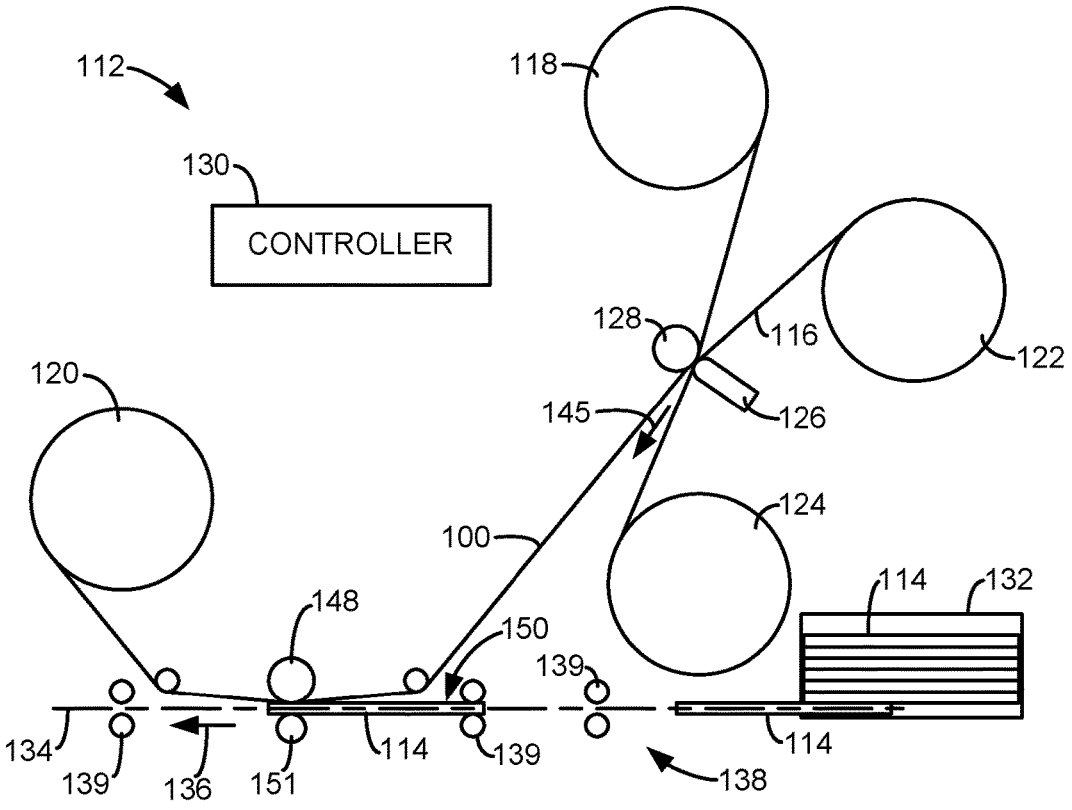
FIG. 2 is a simplified side view of an exemplary transfer lamination device in accordance with embodiments of the invention.

FIG. 2 is a simplified side view of an exemplary transfer lamination device 112 in accordance with embodiments of the invention. In some embodiments, the device 112 is in the form of a credential manufacturing device configured to produce credentials, such as driver's licenses, by processing a credential substrate 114 using the methods described herein. Motors, gears, circuitry and other conventional components are not depicted in FIG. 2 in order to simplify the illustration.

The substrate 114 may take on many different forms, as understood by those skilled in the art. In some embodiments, the substrate 114 is a credential substrate. As used herein, the term "credential substrate" includes substrates used to form credentials, such as identification cards, membership cards, proximity cards, driver's licenses, passports, credit and debit cards, and other credentials or similar products. Exemplary card substrates include paper substrates other than traditional paper sheets used in copiers or paper sheet printers, plastic substrates, rigid and semi-rigid card substrates and other similar substrates.

Embodiments of the device 112 include the transfer ribbon 100 and a print ribbon 116. In some embodiments, the print ribbon 100 is supported between a supply spool 118 and a take up spool 120, and the print ribbon 116 is supported between a supply spool 122 and a take up spool 124. Motors may be used to drive the supply and take up spools and feed the print and transfer ribbons as necessary, in accordance with conventional techniques.

In some embodiments, the device 112 includes a print head 126 and a print platen 128. The print head 126 is a conventional thermal print head comprising a plurality of heating elements 142 that may be individually activated. The print head 126 is configured to press the print ribbon 116 against the transfer ribbon 100 under the support of the print platen 128.

In some embodiments, the print ribbon 116 comprises a plurality of conventional print panels, such as colored dye panels, black resin panels, and/or other conventional print panels. Thus, the device 112 may be used to print an image to the surface 108 of the transfer layer 102 using the print ribbon 116 and the print head 126. The transfer layer can then be laminated to the substrate 114 as described below to complete a reverse-image printing process.

In some embodiments, the device 112 includes a controller 130 which represents at least one processor. The controller 130 uses the processor to execute program instructions stored in memory of the controller 130 or other location, to control components of the device 112 using conventional techniques, and perform functions and method steps described herein.

In some embodiments, the device 112 includes a substrate supply 132 (e.g., hopper, or cartridge) containing a plurality of the substrates 114. In some embodiments, the controller 130 controls the feeding of individual substrates 114 from the supply 132 along a processing path 134 in a feed direction 136 through the control of a conventional motorized transport mechanism 138. Embodiments of the transport mechanism 138 include motorized feed rollers or pinch roller pairs 139, or other conventional components.

In some embodiments, the print ribbon 116 comprises a plurality of colored dye panels (e.g., Y panels, M panels, C panels), black resin panels (e.g., K panels), heat seal panels (e.g., H panels) and/or other conventional thermal print ribbon panels. In some embodiments, the print ribbon 116 includes an adhesive or inhibitor panel 140, shown in the simplified side view of the printing section of the device 112 provided in FIG. 3, which may be used to remove select portions of the transfer layer 102 from the carrier layer 104, as discussed below.

Figure 5:
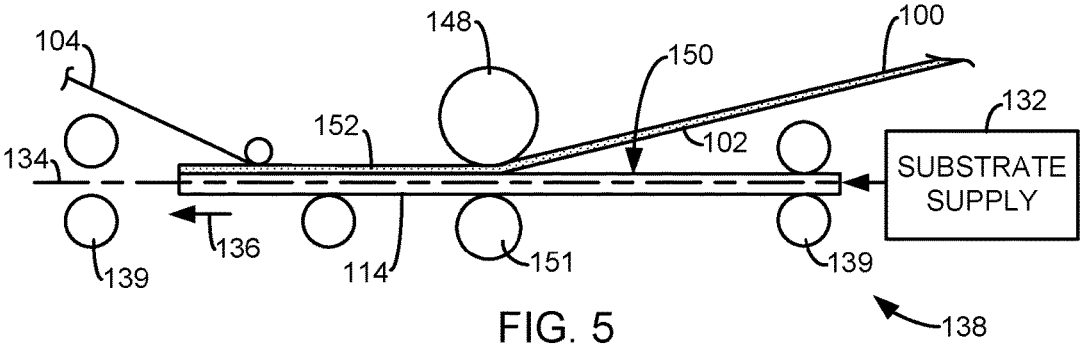
FIG. 5 is a simplified side view of a laminating section of the device of FIG. 2.
Figure 6:
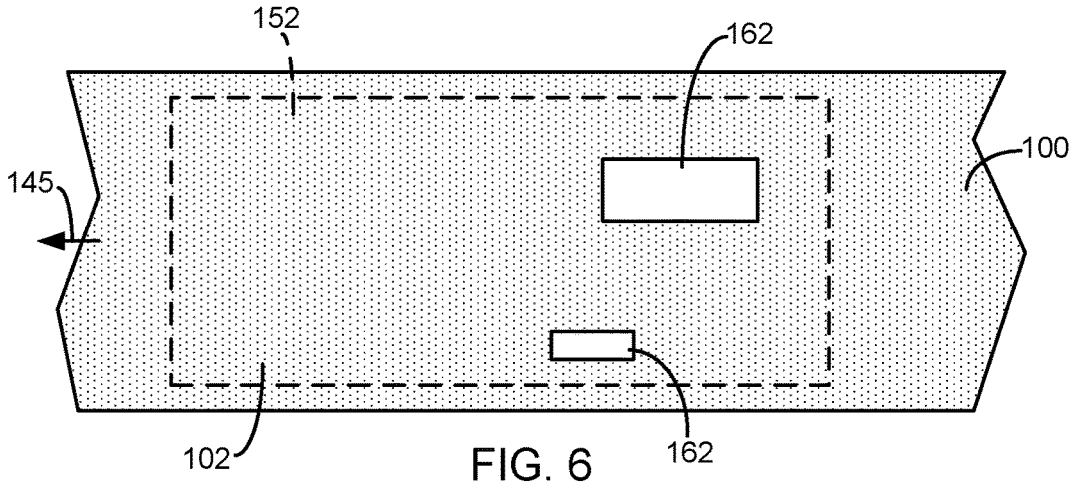
FIG. 6 is a simplified top view of a transfer ribbon in accordance with embodiments of the invention.

In some embodiments, the device 112 is configured to print an image to a transfer section 152 (FIG. 6) of the transfer layer 102 in accordance with conventional techniques. In some embodiments, the print head 126 includes a plurality of resistive heating elements 142 (FIG. 4) that may be selectively activated (shaded boxes 142) to heat and transfer print material (i.e., dye, resin, etc.) from the panels of the print ribbon 116 to the transfer section 152 of the transfer layer 102. The transfer section 152 corresponds to a section of the transfer layer 102 having a surface area that substantially matches the surface 150 of the substrate 114 that is to receive the image or be laminated. In the transfer printing process, the imaged transfer section 152 is laminated to the surface 150 of the substrate 114 using the transfer device 108, as illustrated in FIG. 5.

Figure 7:
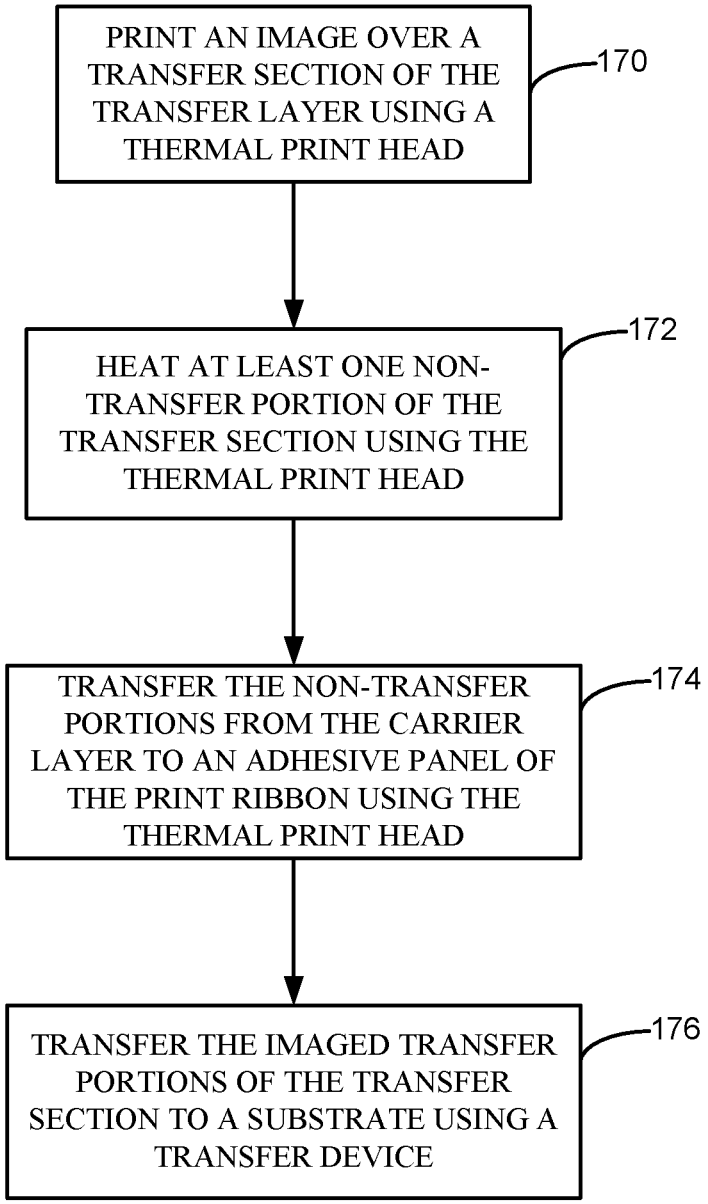
FIG. 7 is a flowchart illustrating a method in accordance with embodiments of the invention.

Some embodiments are directed to an improved transfer printing method that removes non-transfer portions 146 of the transfer section 152 from carrier layer 104 before the transfer section 152 is laminated to the surface 150 of the substrate 114. FIG. 7 is a flowchart illustrating the method in accordance with exemplary embodiments of the invention. At 170, an image is printed over a transfer section 152 of the transfer layer 102 using a thermal print head 126 and a print ribbon 116, such as using the technique described above. In some embodiments of step 170, dye material from the colored dye panels of the print ribbon 116, and/or black resin material from the black resin panel are printed or applied to the surface 108 of the transfer layer 102 within the print section 152 to form the desired image thereon.

At 172 of the method, at least one non-transfer portion 146 of the transfer section 152 is heated using the thermal print head 126. In some embodiments, the heating step 172 operates to pre-heat the non-transfer portions 146 and/or at least partially activate the release layer 109 of the transfer layer 102 immediately beneath the non-transfer portions 146. This reduces the adhesion of the non-transfer portions 146 to the carrier layer 104, and facilitates the proper transfer of the non-transfer portions to the adhesive panel (inhibitor) during the following step (step 174). In some embodiments, the print head 126 selectively activates the resistive heating elements 142 (shaded boxes) shown in the simplified front view of the printing section of the device 112 provided in FIG. 4, to thermally heat the at least one non-transfer portion 146.

In some embodiments, the performance of the heating step 172 occurs before, during or after the printing step 170. Thus, in some embodiments, the heating step 172 is distinct from the image printing step 170. For example, even though the image printed in step 170 may involve heating of portions of the non-transfer portions 146 and transferring print material to the portions, some embodiments of the heating step 172 would involve a distinct step of heating the portions either before or after the image printing step.

Figure 4:
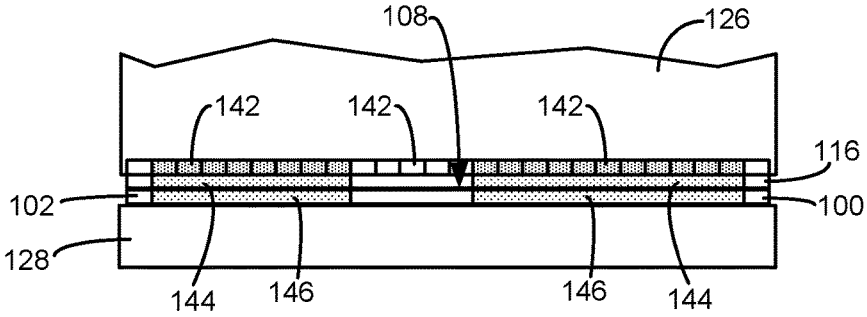

In some embodiments, the heating step 172 is performed through a portion of the print ribbon 116, as shown in FIG. 4. Thus, the activated heating elements 142 transfer heat through portions 144 of the print ribbon 116 to the non-transfer portions 146.

In some embodiments, the heating step 172 is performed through a black resin panel (e.g., K panel) of the print ribbon 116. In some embodiments, the heating step 172 heats and activates portions 144 of the black resin panel of the ribbon 116. This heats the non-transfer portions 146 and causes black resin to transfer to the surface 108 of the non-transfer portions 146. In some embodiments, the entire surface 108 of the non-transfer portions 146 receives the black resin. That is, in some embodiments, black resin is applied or printed over the entire surface 108 of the at least one non-transfer portion 146 in step 172. In addition to pre-heating the non-transfer portions 146 and reducing adhesion between the non-transfer portions 146 and the carrier layer 104 by, for example, at least partially activating the release layer 109 of the transfer layer 102 immediately beneath the non-transfer portions 146, the use of the black resin panel for the heating step has an additional positive effect on the removal of the non-transfer portions by the adhesive panel (inhibitor) at the next step (step 174). In particular, the black resin layer deposited over the surface of the non-transfer portions 146 reinforces or increases the adhesion of the non-transfer portions 146 to the adhesive panel of the transfer ribbon 100.

In some embodiments, the heating step 172 is performed through a heat seal panel (e.g., H panel) of the print ribbon 116. In some embodiments, the heating step 172 activates portions 144 of the heat seal panel of the ribbon 116, and causes heat and heat seal material, such as a thermal adhesive or resin (hereinafter referred to as "resin"), to transfer to the non-transfer portions 146. In some embodiments, the entire non-transfer portion 146 receives the resin. That is, in some embodiments, the resin of the heat seal panel is applied or printed over the entire surface of the at least one non-transfer portion 146 in step 172. In addition to pre-heating the non-transfer portions 146 and reducing adhesion between the non-transfer portions 146 and the carrier layer 104 by, for example, by at least partially activating the release layer 109 of the transfer layer 102 immediately beneath the non-transfer portions 146, the application of the resin from the heat seal panel to the at least one non-transfer portion 146 increases the adhesion of the non-transfer portions 146 to the adhesive panel in the subsequent transfer step 174. Thus, the use of the heat seal panel for the heating step 172 aides in the removal of the non-transfer portions 146.

In some embodiments, print material from the print ribbon 116, such as dye, resin, and adhesive, is not transferred from the print ribbon 116 to the surface 108 of the at least one non-transfer portion 146 during the heating step 172. In some embodiments, the heating step 172 activates portions 144 of a blank panel (i.e., void panel) or a previously used panel of the print ribbon 116, that does not contain a transferable material. Thus, in some embodiments, only heat is transferred through the print ribbon 116 to the at least one non-transfer portion 146 of the transfer section 152. The advantage of this embodiment is that one can freely define the heating parameters (temperature and time) of the heating step. There are no limitations due to any transfer material which could create unexpected issues when heated over given temperatures. Therefore, the heating parameters of the print head 126 can be more freely defined to take into account the thermal characteristics and thickness of the protective layer 110 to ensure that the release layer 109 of the transfer layer 102 immediately beneath the non-transfer portions 146 is fully or at least partially activated.

Figure 3:
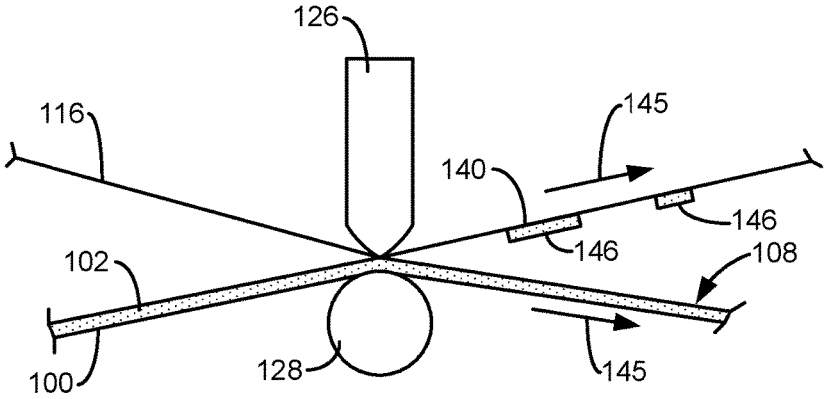
FIGS. 3 and 4 respectively are simplified side and front views of a printing section of the device of FIG. 2.

At 174 of the method, the non-transfer portions 146 of the transfer section 152 are transferred from the carrier layer 104 to an adhesive panel of the print ribbon 116 using the thermal print head 126. In some embodiments, the adhesive panel 140 includes a thermal adhesive layer that is not configured to transfer from the carrier layer 104 when heated using the print head 126, as shown in FIG. 3. In some embodiments, step 174 is generally the same as step 172, except the adhesive panel 140 of the print ribbon 116 is positioned between the at least one non-transfer portion 146 and the heating elements 142 of the print head 126.

In some embodiments of step 174, the print head 126 selectively activates the resistive heating elements 142 (shaded boxes) shown in FIG. 4 to thermally heat the portions 144 of the adhesive panel corresponding to (i.e., overlaying) the at least one non-transfer portions 146, as the adhesive panel 140 and the transfer ribbon 100 are fed past the print head 126 in a feed direction 145 (FIG. 3). The thermally activated portions 144 of the adhesive panel bond to the corresponding non-transfer portions 146 of the transfer layer 102. As the print ribbon 116 is pulled away from the transfer ribbon 100, the bonded portions 144 of the adhesive panel 140 remove the corresponding non-transfer portions 146 of the transfer layer 102 from the carrier layer 104, as shown in FIG. 3. It is understood that the device 112 may include a roller, located downstream of the print head 126 relative to the feed direction 145, that controls the location where the adhesive panel 140 is peeled from the transfer ribbon 100.

Following step 174, the imaged transfer section 152 includes transfer layer gaps 162 (FIG. 6) where the non-transfer portions 146 of the transfer layer 102 have been removed in step 174 using the adhesive panel of the print ribbon 116. The gaps 162 may correspond to features on the surface 150 of the substrate 114, such as a magnetic stripe, a signature panel, a surface hologram feature, electrical contacts of a smartcard module, and/or other feature of the substrate 114, where the transfer layer 102 should not be applied.

At 176 of the method, the remainder of the transfer section 152, such as the remaining imaged transfer portions of the transfer section 152, are transferred to the surface 150 of the substrate 114 using a transfer device 148, such as a heated laminating roller. In some embodiments, the transfer device 148 presses the transfer ribbon 100 against the surface 150 of a credential substrate 114 supported on a platen 151, as shown in the side view of the laminating section provided in FIG. 5. The transfer device 148 heats the transfer section 152 including the thermal adhesive layer to bond the remaining transfer portions of the transfer section 152 to the surface 150 of the substrate 114.

Figure 8:
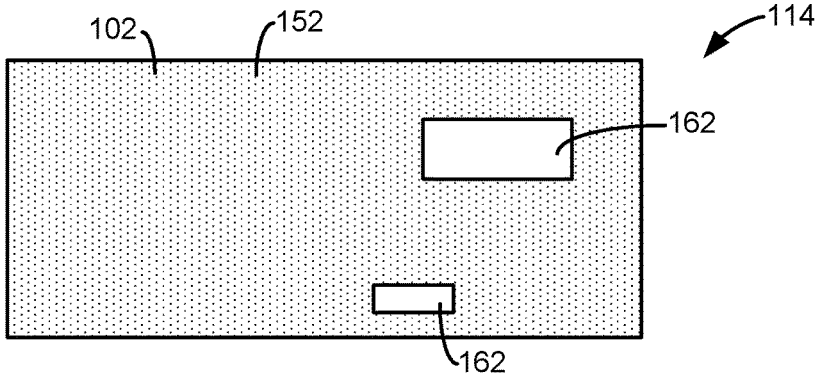
FIG. 8 is a simplified top plan view of a processed substrate in accordance with embodiments of the invention.

Following the lamination or transfer step 176, the processed card substrate 114 includes the transfer section 152 of the transfer layer 102 on the surface 150, as shown in the simplified top plan view of the processed substrate provided in FIG. 8. Thus, in some embodiments, the entire surface 150 of the substrate 114 is covered by the transfer section 152 of the transfer layer 102, except for the gaps 162 corresponding to the removed non-transfer portions 146. The processed card substrate 114 may then be discharged from the device 112 into a hopper, or fed to another processing component of the device 112 (e.g., substrate rotator, data encoder, etc.), for example, for additional processing.

Some embodiments are directed to a lamination process, in which the above-described printing step 170 is not necessarily performed. Accordingly, the lamination process involves performing embodiments of steps 172, 174 and 176 described above to laminate a substrate 114 with a transfer section 152 having gaps 162 where selected non-transfer portions 146 have been removed.

Although the present invention has been described with reference to preferred embodiments, workers skilled in the art will recognize that changes may be made in form and detail without departing from the spirit and scope of the invention.

What is claimed is:

1. A transfer printing method using a transfer ribbon that includes a transfer layer on a carrier layer, the method comprising:

printing an image over a transfer section of the transfer layer using a thermal print head and a print ribbon;

heating at least one non-transfer portion of the transfer section using the thermal print head without bonding the at least one non-transfer portion of the transfer section to the print ribbon;

transferring the at least one non-transfer portion of the transfer section from the carrier layer to an adhesive panel of the print ribbon using the thermal print head, wherein imaged transfer portions remain adhered to the carrier layer; and transferring the imaged transfer portions of the transfer section from the carrier layer to a substrate using a transfer device.

2. The method according to claim 1, wherein heating at least one non-transfer portion of the transfer section using the thermal print head comprises transferring a resin to the at least one non-transfer portion.

3. The method according to claim 2, wherein transferring a resin to the at least one non-transfer portion comprises transferring the resin over an entire surface of the at least one non-transfer portion.

4. The method according to claim 2, wherein transferring a resin to the at least one non-transfer portion comprises transferring the resin from a resin panel of the print ribbon.

5. The method according to claim 4, wherein the resin panel is a black resin panel or a heat seal panel.

6. The method according to claim 1, wherein heating at least one non-transfer portion of the transfer section using the thermal print head comprises heating the at least one non-transfer portion of the transfer section through the print ribbon.

7. The method according to claim 6, wherein heating the at least one non-transfer portion of the transfer section through the print ribbon comprises heating the at least one non-transfer portion without transferring material from the print ribbon to the at least one non-transfer portion.

8. The method according to claim 6, wherein heating the at least one non-transfer portion of the transfer section through the print ribbon comprises heating the at least one non-transfer portion through a blank or used panel of the print ribbon.

9. The method according to claim 6, wherein heating at least one non-transfer portion of the transfer ribbon reduces adhesion of the at least one transfer portion to the carrier layer.

10. The method according to claim 6, wherein heating at least one non-transfer portion of the transfer section occurs during printing an image over a transfer section of the transfer layer.

11. The method according to claim 6, wherein heating at least one non-transfer portion of the transfer section occurs before or after printing an image over a transfer section of the transfer layer.

12. The method according to claim 6, wherein transferring the non-transfer portions of the transfer section from the carrier layer to an adhesive panel using the thermal print head comprises positioning the adhesive panel between the print head and the non-transfer portions, and bonding the non-transfer portions to the adhesive panel including heating portions of the adhesive panel that correspond to the non-transfer portions using the print head.

13. The method according to claim 6, wherein the transfer layer includes a protective layer having a thickness of greater than 12 μm.

* * * * *